US010081950B2

(12) United States Patent
Bizzarri et al.

(10) Patent No.: US 10,081,950 B2
(45) Date of Patent: Sep. 25, 2018

(54) GUARD RAIL SYSTEM

(71) Applicant: CPG International LLC, Skokie, IL (US)

(72) Inventors: Paul Bizzarri, Mason, OH (US); Jason A. Davoll, Chicago, IL (US); Michael A. Gori, Norton, OH (US); Richard Arthur Pearson, II, Campbell, MO (US); Ronald Keith Turner, Elmer, LA (US)

(73) Assignee: CPG International LLC, Skokie, IL (US)

( * ) Notice: Subject to any disclaimer, the term of this patent is extended or adjusted under 35 U.S.C. 154(b) by 366 days.

(21) Appl. No.: 15/042,637

(22) Filed: Feb. 12, 2016

(65) Prior Publication Data

US 2017/0234015 A1 Aug. 17, 2017

(51) Int. Cl.
*E04F 11/18* (2006.01)

(52) U.S. Cl.
CPC ..... *E04F 11/1836* (2013.01); *E04F 11/1817* (2013.01); *E04F 2011/1827* (2013.01); *E04F 2011/1889* (2013.01)

(58) Field of Classification Search
CPC ..... E04H 17/1417; E04H 17/1426; E04H 17/1439; E04F 11/18; E04F 11/1802; E04F 11/181; E04F 2011/1825; E04F 2011/1827
See application file for complete search history.

(56) References Cited

U.S. PATENT DOCUMENTS

| | | | | |
|---|---|---|---|---|
| 3,313,527 | A * | 4/1967 | Torsten | E04F 11/181 256/21 |
| 3,498,589 | A * | 3/1970 | Murdock | E04F 11/181 256/21 |
| 3,879,017 | A * | 4/1975 | Maxcy | E04F 11/181 256/22 |
| 3,955,799 | A * | 5/1976 | Lauzier | E04F 11/181 256/21 |
| 4,014,520 | A * | 3/1977 | Walters | E04F 11/181 256/22 |
| 4,050,828 | A * | 9/1977 | Noro | E04F 11/181 256/22 |
| 7,472,482 | B2 | 1/2009 | Pratt | |
| 7,731,160 | B2 | 6/2010 | Terrels et al. | |
| 7,748,686 | B1 | 7/2010 | Harder | |
| 8,033,530 | B2 | 10/2011 | Timothy | |
| 8,113,489 | B1 | 2/2012 | Harder | |
| 8,282,083 | B1 | 10/2012 | Poma | |
| 8,615,964 | B1 | 12/2013 | Poma et al. | |
| 2016/0230413 | A1 * | 8/2016 | Springborn | E04H 17/1421 |

* cited by examiner

*Primary Examiner* — Michael P Ferguson
(74) *Attorney, Agent, or Firm* — Buchanan Ingersoll & Rooney PC

(57) ABSTRACT

A guard rail system that is assembled from a kit of components that includes bottom rails, top rails and balusters and U-shaped top rail inserts that fit into the underside of the top rails. The tops of the balusters are inserted through the spaced apart holes in the base of the insert. The top rail has a body and a pair of spaced apart legs extending downward from the body. After the system has been assembled the legs engage the uprights of the top rail insert to create a compression fit between the top rail insert and the tops of the balusters.

8 Claims, 4 Drawing Sheets

GUARD RAIL SYSTEM

FIELD OF THE INVENTION

The invention relates to guard rail systems. In particular, this invention relates to guard rail systems which are fabricated at the site of installation from kits of components.

BACKGROUND OF THE INVENTION

Guard rails are used around decks, staircases and other elevated structures, to prevent injury and possible death from falling off of the edge of such structures. Most building codes have rigid requirements for guard rails, both in terms of when they are required and certain construction parameters, including for example the maximum spacing between balusters, length of span, height and load requirements.

The installation of guard rail systems can be a very labor intensive procedure. Balusters must be installed at precise intervals, and be substantially true to the vertical, both to comply with building code requirements and to be aesthetically acceptable.

Guard rails can be constructed from lumber, and frequently are in order to keep costs down. In a typical lumber guard rail construction balusters or pickets are nailed or screwed to top and bottom rails, which in turn are nailed to posts secured to or around the structure. A considerable amount of attention is required to ensure that the balusters are evenly spaced and vertical, and there is a limit to the aesthetic appeal which can be achieved. Moreover, the resulting guard rail is subject to separation, warping and other weathering effects over time, due to limits on the strength and degree of structural integration which can be achieved using nails and lumber.

Guard rails can also be fabricated from components that typically include bottom rails, top rails, balusters that fit between the top rails and the bottom rails, posts and hardware that includes screws and brackets for connecting the components together. The top rails, bottom rails, balusters and posts typically are extruded components made of aluminum, plastic or another suitable material. An example of this type of guard rail is disclosed in U.S. Pat. No. 7,472,482 B2 to Pratt. As is typical in this type of guard rail system, Pratt teaches that balusters which are preferably (but not necessarily) extruded, are fastened to a lower rail and to an upper retainer at fixed intervals. The balusters are provided with central bores for receiving fasteners such as screws through predrilled holes in the upper retainer and lower rail.

Whether cut from lumber or extruded, the assembly and installation of the guard rail requires considerable skill, labor and time in order to construct a guard rail which is both structurally secure and appealing. There is a need for a guard rail system that is easier and less time consuming to install than the guard rail systems that are currently available in the market. This guard rail system must also be durable, meet all applicable building code requirements and be aesthetically appealing.

SUMMARY OF THE INVENTION

We provide a guard rail system that is assembled from a kit of components that includes bottom rails, top rails and balusters. Our kit also includes top rail inserts that fit into the underside of the top rails. The top rail insert has a base with spaced apart openings, each opening sized to receive a baluster. A pair of uprights is attached to the base. Each upright has a bottom edge attached to the base and a top edge opposite the bottom edge, an inside surface and an outside surface. There is a flange extending from the inside surface of each upright adjacent to the top edge and a rib on the outside surface of each upright. The uprights are spaced apart a sufficient distance between their bottom edges to receive the balusters between the inside surfaces of the uprights. The flanges on the uprights are in a common plane and stop the balusters as they are inserted through the spaced apart holes in the base of the insert.

The top rail has a body and a pair of spaced apart legs extending downward from the body. Each leg has an inside surface that faces the inside surface of the other leg. The legs are spaced apart a sufficient distance to receive and grip the uprights of the top rail insert. Each leg has a projection on the inner surface of that leg. The projection is sized and positioned to pass over the rib on the outside surface of one of the uprights on the top rail insert when the top rail is attached to the top rail insert. The installer should be able to hear an audible click immediately after the projection passes over the rib. We prefer to provide a ledge on the outer surface of each upright which stops the leg of the top rail from continuing to move after the projection has passed over the rib. When the top rail, top rail insert and balusters are assembled in this way the uprights of the top rail insert press against the upper end of each baluster to create a compression fit. No screws are used to connect the balusters to the top rail or the top rail insert.

We provide a bottom rail which has spaced apart openings to receive the balusters. Preferably a pair of spaced-apart flanges are provided adjacent each opening which engage the bottom end of the baluster to create a friction fit. No screws are used to attach the balusters to the bottom rail.

Other advantages of our guard rail system will become apparent from certain present preferred embodiments shown in the drawings.

DESCRIPTION OF THE PREFERRED EMBODIMENTS

Figure 5:
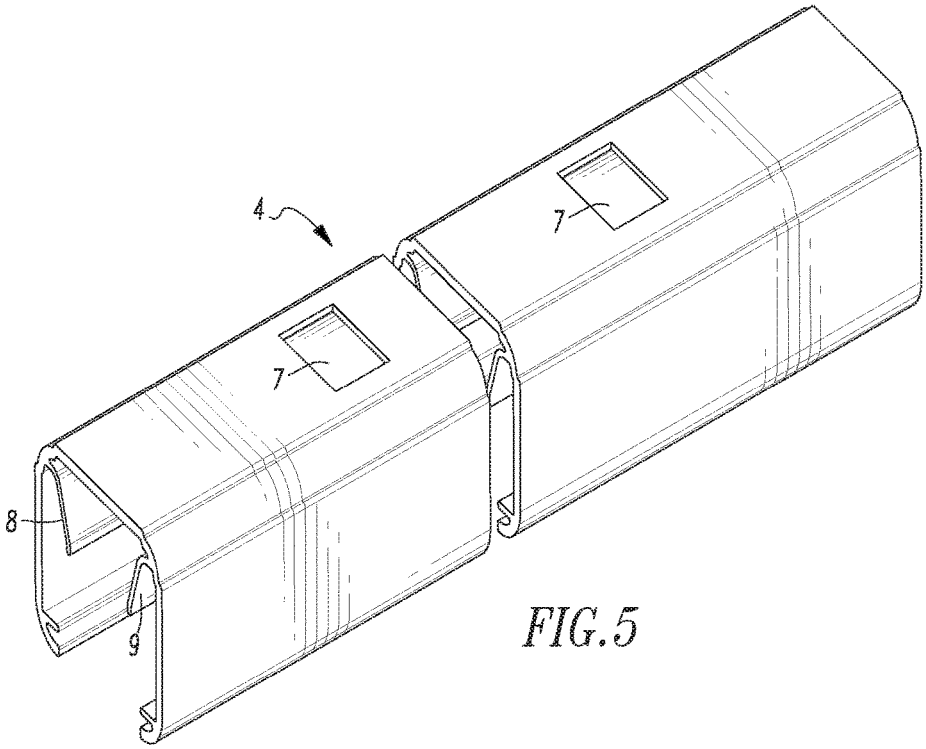
FIG. 5 is a perspective view of the bottom rail in the guard rail system shown in FIG. 1.

As shown in the drawings we provide a guard rail system 1 having a top rail 2, a top rail insert 3, a bottom rail 4 and balusters 5. The bottom rail 4 is preferably U-shaped and has a bottom rail insert 6 which together with the bottom rail form a tubular structure. A series of spaced apart openings 7 in the bottom rail receive the bottom ends of the balusters. The balusters are inserted into the bottom rail until they rest on the bottom rail insert. As can be seen most clearly in FIGS. 5 and 7, we prefer to provide a pair of spaced apart flanges 8, 9 adjacent the openings which engage the bottom end of the balusters to provide a friction fit. The bottom rail and bottom rail insert are preferably aluminum extrusions.

Figure 4:
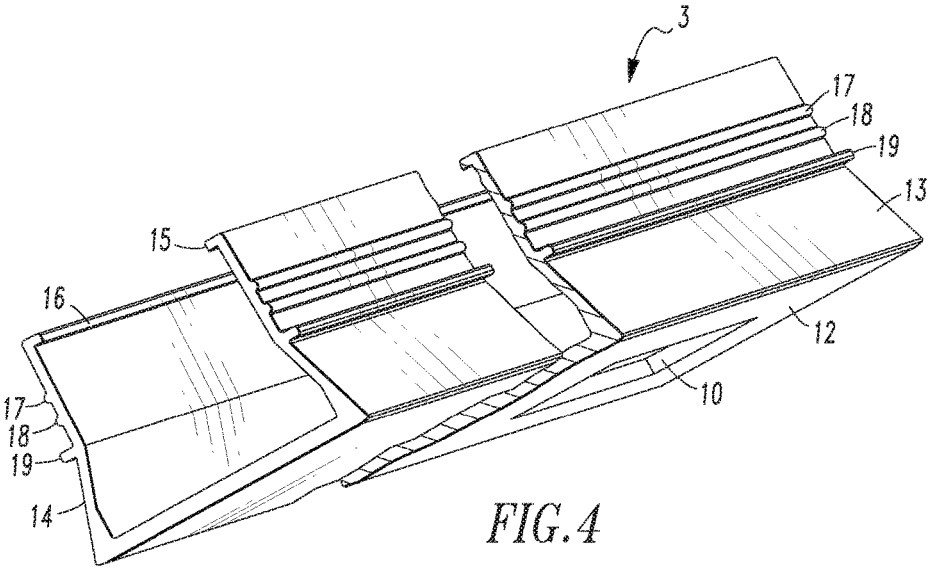
FIG. 4 is a perspective view of the top rail insert in the guard rail system shown in FIG. 1.

The tops of the balusters fit into spaced apart openings 10 in the bottom 12 of the top rail insert 3. Uprights 13, 14 extend from the bottom 12 of the top rail insert. There is a flange 15, 16 extending from the inside surface of each upright adjacent to the top edge of the upright. See FIG. 4. Two ribs 17, 18 are provided on the outside surface of each upright 13, 14. The uprights are spaced apart a sufficient distance between their bottom edges to receive the balusters between the inside surfaces of the uprights. The flanges 15, 16 on the uprights are in a common plane and the flanges define a space between the top edges of the flanges and below the flanges that is close to the selected width of the balusters. In a present preferred embodiment of our guard rail system, the balusters have a width of about 0.75 inches; the space between the bottoms of the uprights is about one inch and the space between the top of the uprights immediately below the flanges is about 0.8 inches. The tops of the balusters are inserted through the spaced apart holes in the base of the insert until the top of the baluster hits the flanges 15, 16.

Figure 3:
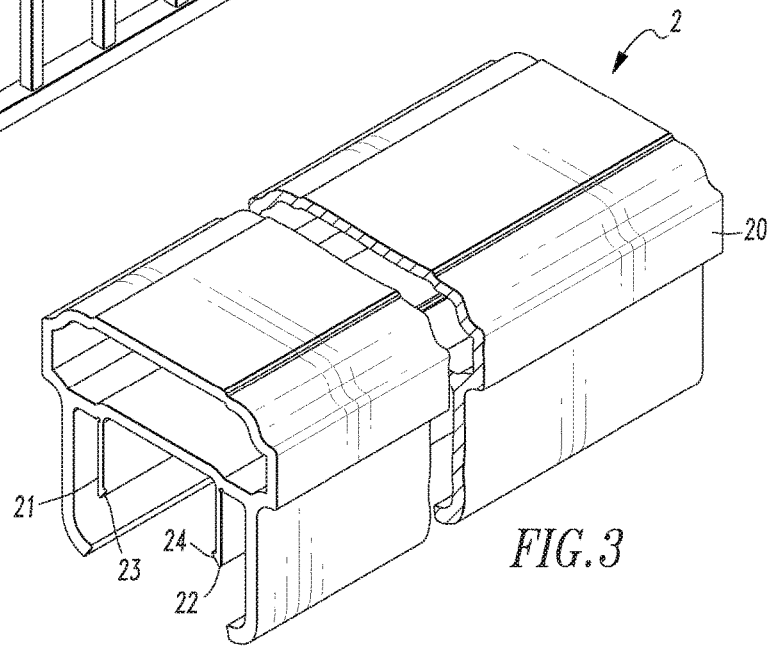
FIG. 3 is a perspective view of the top rail in the guard rail system shown in FIG. 1.
Figure 6:
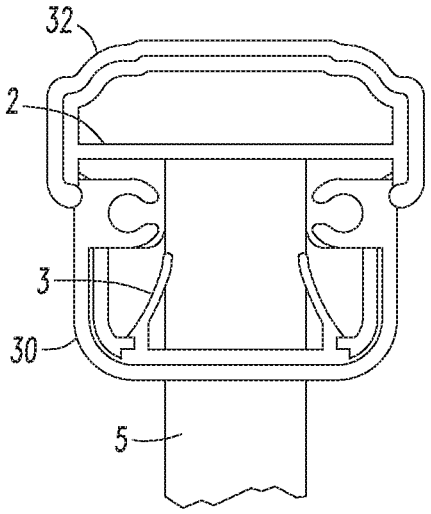
FIG. 6 is an end view taken along the line VI-VI in FIG. 1.

As can be seen most clearly in FIG. 3, the top rail 2 has a body 20 and a pair of spaced apart legs 21, 22 extending downward from the body. Each leg has an inside surface that faces the inside surface of the other leg. The legs 21, 22, are spaced apart a sufficient distance to receive and grip the uprights 13, 14 of the top rail insert 3. See FIG. 6. Each leg has a projection 23, 24 on the inner surface of that leg. The projection 23, 24 is sized and positioned to pass over the rib or ribs 17, 18 on the outside surface of the uprights 13, 14 on the top rail insert 3 when the top rail is attached to the top rail insert. The installer should be able to hear an audible click immediately after the projection passes over a rib. We prefer to provide a ledge 19 on the outer surface of each upright which stops the leg of the top rail from continuing to move much further after the projection has passed over the rib. When the top rail has been attached to the top rail insert in this way the legs 21, 22 press the upper portion of the uprights 13, 14 against the tops of the balusters creating a compression fit. We prefer to provide sides 26, 27 that extend from the body 20 and conceal the legs 21, 22 and the top rail insert 3 which are between them when the guard rail system has been assembled. The sides can be contoured or have any desired shape because they do not support the top rail or any load that may be on the top rail. We prefer that the top rail and the top rail insert be aluminum extrusions, but they could be made of plastic or other suitable materials. No screws are used to connect the balusters to the top rail insert or the top rail.

Figure 1:
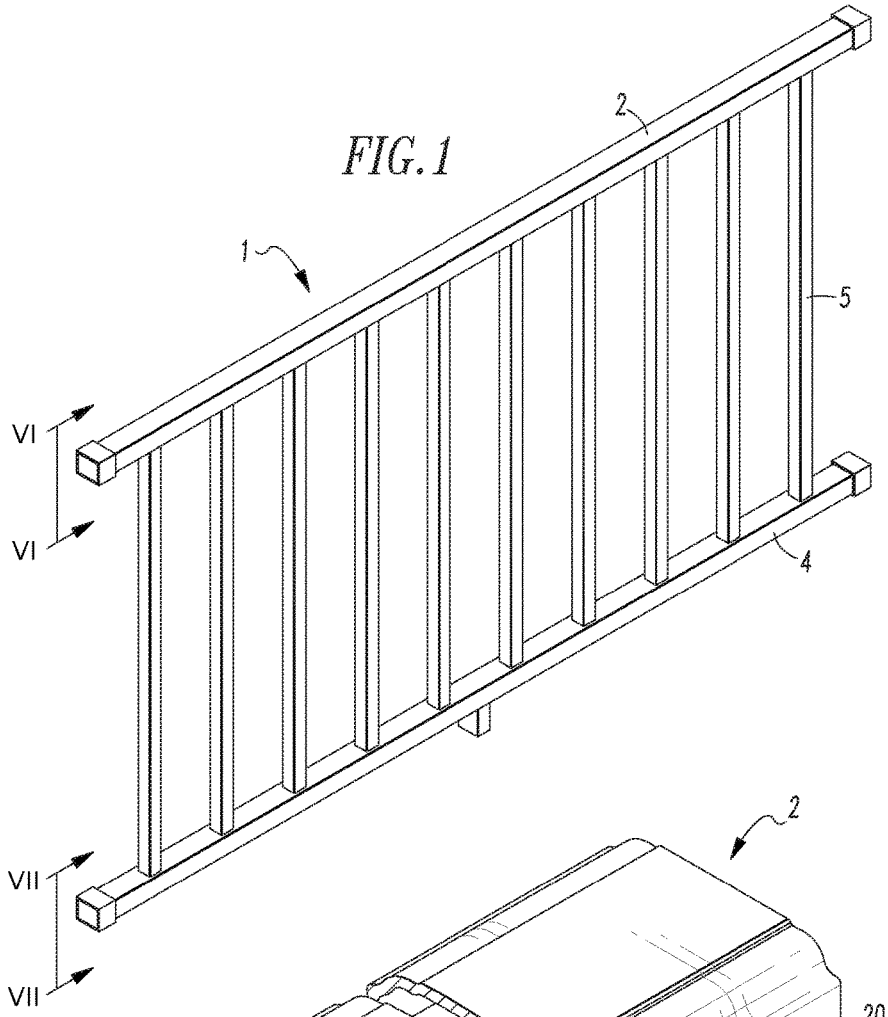
FIG. 1 is a perspective view of a present preferred embodiment of our guard rail system.
Figure 2:
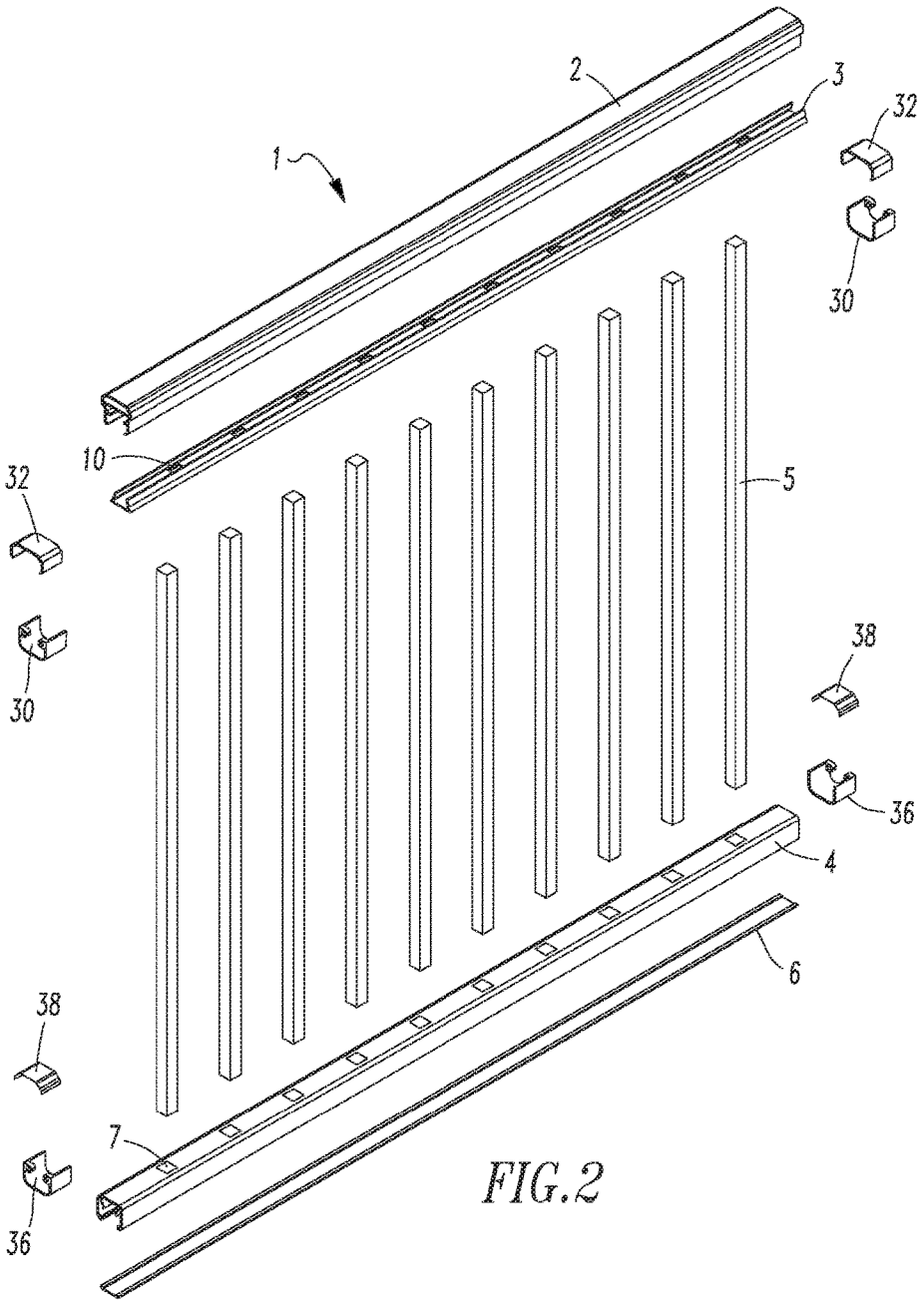
FIG. 2 is an exploded perspective view of the guard rail system shown in FIG. 1.
Figure 7:
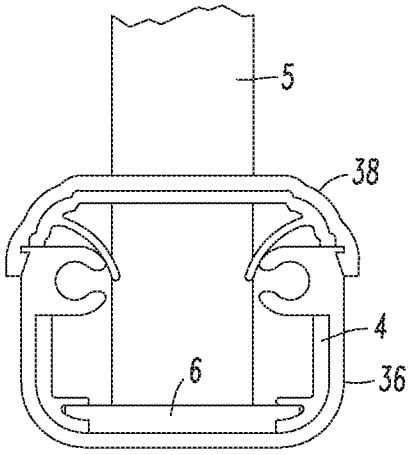
FIG. 7 is an end view taken along the line VII-VII in FIG. 1.

We prefer to make the top rail, the top rail insert, the bottom rail and the bottom rail insert in standard lengths of 6, 8 or 10 feet. FIGS. 1 and 2 show only one length of these components. For installations that require railings that are longer than the standard length or lengths in which these components are sold, we provide couplings to connect two top rails with top rail inserts and to connect two bottom rails with bottom rail inserts together. These couplings can be seen in FIGS. 1, 2, 6 and 7. The coupling used to connect two top rails with top rail inserts together consists of a U-shaped bottom saddle bracket 30 having either a slot or a projection near the top of each upright. This bracket fits on the underside of the top rail. A generally inverted U-shaped top bracket 32 fits over the top of the top rail. Each leg of the top bracket has a projection that engages the slot or projection on an upright of the saddle bracket to hold the top bracket and the bottom saddle bracket together as can be seen in FIG. 7. The coupling for the bottom rails is similar in construction. A bottom saddle bracket 36 having either a slot or a projection near the top of each upright fits on the underside of the bottom rail. A generally inverted U-shaped top bracket 38 fits over the top of the bottom rail. As can be seen in FIG. 8, each leg of the top bracket 38 has a projection that engages the slot or projection on an upright of the saddle bracket to hold the top bracket and the bottom saddle bracket together.

The guard rail system disclosed here can be installed much faster than the conventional guard rail systems because screws are not used to connect the balusters to the top rail and screws are not used to connect the balusters to the bottom rail. If desired one could use a conventional bottom rail with spaced apart holes for a screw that fits into a hole in a retainer in place of the bottom rail disclosed here. A system having a conventional bottom rail and the top rail disclosed here would be easier and take less time to install than a conventional guard rail system in which screws are used to connect the balusters to the top rail.

The assembled guard rail system shown in FIG. 1 can be installed on a substantially level surface such as a deck or on stairs, ramps or other sloped structures. Those skilled in the art will recognize that the ends of the balusters need not be cut to enable this guard rail system to be used on a sloped surface. This guard rail system can also be used to construct gates that slide on a track or are mounted with hinges.

While we have described and shown certain present preferred embodiments of our guard rail system, it is to be distinctly understood that our invention is not limited thereto but may be variously embodied within the scope of the following claims.

We claim:

1. A guard rail system comprising:

a bottom rail;

a plurality of spaced-apart balusters, each baluster having a bottom end attached to the bottom rail and a top end;

a top rail insert comprised of:

a base, the base having a plurality of spaced apart openings, each opening sized to receive a baluster;

a pair of spaced-apart uprights attached to the base, each upright having a bottom edge attached to the base and a top edge opposite the bottom edge, an inside surface, an outside surface, a flange extending from the inside surface adjacent to the top edge and a rib on the outside surface, and a ledge extending from the outside surface of each upright at a selected location between the rib and the bottom edge of the upright;

wherein the uprights are spaced apart a sufficient distance to receive the top ends of the balusters between the inside surfaces of the uprights, and the flanges of the uprights are in a common plane; and a top rail having a body and a pair of legs attached to the body, each leg having an inside surface that faces the inside surface of the other leg, the legs spaced apart a sufficient distance to receive and grip the uprights of the top rail insert, each leg having a projection on the inner surface of that leg, the projection sized and positioned to pass over the rib on the outside surface of one of the uprights on the top rail insert when the top rail is attached to the top rail insert;

wherein each ledge is sized to stop the pair of legs from moving past the ledge;

wherein the top end of each baluster passes through a respective one of the openings in the base of the top rail insert until the top end abuts the flanges of the uprights of the top rail insert, and the legs of the top rail press against the uprights of the top rail insert when the top rail is attached to the top rail insert, the legs resiliently deflecting the uprights inward toward each other and providing a compression fit in which at least a portion of the inside surface of each upright between the top edge and the ledge presses against the baluster.

2. The guard rail system of claim 1 also comprising a second rib extending from the outside surface of each upright at a selected location between the top edge and the ledge of the upright.

3. The guard rail system of claim 1 also comprising a pair of spaced apart sides attached to the body of the top rail such that the pair of legs is between the spaced apart sides.

4. The guard rail system of claim 1 wherein the body of the top rail is hollow.

5. The guard rail system of claim 1 wherein at least one of the bottom rail, the top rail, the top rail insert and the balusters is an aluminum extrusion.

6. The guard rail system of claim 1 wherein the bottom rail has a plurality of spaced apart openings and one of the balusters is in each opening.

7. The guard rail system of claim 6 also comprising a pair of spaced apart flanges adjacent each opening in the bottom rail, the flanges engaging the baluster within that opening to create a friction fit.

8. The guard rail system of claim 1 wherein the bottom rail is U-shaped and further comprising a bottom rail insert attached to the bottom rail such that the bottom rail and the bottom rail insert together form a tubular structure.

* * * * *